US005329656A

United States Patent [19]

Leggett

[11] Patent Number: 5,329,656

[45] Date of Patent: Jul. 19, 1994

[54] INSULATED PUNCTURE RESISTANT INFLATABLE MATTRESS

[75] Inventor: Dennis V. Leggett, 7109 Sontag Way, Springfield, Va. 22153

[73] Assignee: Dennis V. Leggett, Springfield, Va.

[21] Appl. No.: 985,194

[22] Filed: Dec. 3, 1992

[51] Int. Cl.[5] ..... A47C 27/08

[52] U.S. Cl. ..... 5/450; 5/420; 5/481; 5/476; 5/458

[58] Field of Search ..... 5/413, 420, 449, 450, 5/451, 458, 471, 476, 481, 644, 900.5; 267/113, 117, 118, 122; 410/126; 297/DIG. 3, 284.6

[56] References Cited

U.S. PATENT DOCUMENTS

| | | | |
|---|---|---|---|
| Re. 31,898 | 5/1985 | Suter | 5/481 X |
| 2,822,554 | 2/1958 | Wenzelberger | 5/644 |
| 3,298,044 | 1/1967 | Saltness et al. | 5/644 |
| 3,798,636 | 3/1974 | Gaiser | 5/450 X |
| 3,872,525 | 3/1975 | Lea et al. | 5/450 |
| 3,877,092 | 4/1975 | Gaiser | 5/450 X |
| 4,039,363 | 8/1977 | Robertson | 297/DIG. 1 |
| 5,117,517 | 6/1992 | Su | 5/450 |

FOREIGN PATENT DOCUMENTS

| | | | |
|---|---|---|---|
| 3333707 | 8/1984 | Fed. Rep. of Germany | 5/421 |
| 428124 | 7/1967 | Switzerland | 5/450 |
| 1299789 | 12/1972 | United Kingdom | 297/284.6 |

*Primary Examiner*—Michael Trettel
*Attorney, Agent, or Firm*—Stephen Gates; Glenna Hendricks

[57] ABSTRACT

A mattress is disclosed which eliminates components by combining structural integrity, air-impervious and insulating functions, thereby significantly reducing overall weight and increasing portability. In a particularly preferred embodiment the mattress is self-inflating. The semi-rigid cover provides the dimensional rigidity necessary to effect self-inflation. The increased thickness of the utilized cover component affords improved puncture resistance.

9 Claims, 4 Drawing Sheets

INSULATED PUNCTURE RESISTANT INFLATABLE MATTRESS

FIELD OF THE INVENTION

This invention relates to an improved lightweight inflatable mattress.

BACKGROUND OF THE INVENTION

Individuals typically require a comfortable surface, or mattress, on which to recline while sleeping or resting. A variety of applications, such as construction, require a cushioning and/or elevation mechanism. For sleeping or resting, mattresses may be used in both a semi-permanent and a temporary manner. In temporary applications the mattress is removed and stored or rearranged for alternate use when sleeping or resting is ended. A typical alternate use for such a mattress is as a cushion for a sofa or futon. Further, lightweight portable mattresses find use in many other areas. In particular, individuals involved in activities such as camping and backpacking need a mattress which is portable, lightweight, puncture resistant, inflatable or self-inflatable, insulating, and comfortable.

Mattresses intended for camping and backpacking have used a number of approaches to obtain these properties. They include: a) basic chambered air mattresses; b) simple thin resilient insulating pads; c) open-cell resilient foam pads (typically 1 to 2 inches thick); and d) a variety of insulated air mattresses.

Basic chambered air mattresses have been found deficient in several aspects. These mattresses provide very little insulating benefit. Typically such mattresses use a coated synthetic or natural fabric or a plastic sheeting material to form the air-impervious envelope. Where provided, similar materials are used to limit the displacement between the top and bottom envelope surfaces. The substantially non-stretchable nature of these materials limit the capacity of the envelope to respond to sudden pressure surges which can lead to bond failure. Under cold weather conditions, a user loses an excessive amount of heat through the air mattress. An excessive amount of time and effort may be required to inflate these mattresses. Further, all comfort benefits are lost when the mattress is deflated by an accidental puncture. Finally, they provide only moderate comfort benefits.

Thin pads fabricated from natural and synthetic materials also have been used as mattresses. Pads made of natural materials tend to be relatively heavy and provide very little cushioning benefit. Pads made from synthetic materials, such as closed-cell vinyl-nitrile (Ensolite), ethylene-vinyl acetate (EVA), or polyethylene foam, addressed the weight problem but provide only a limited comfort benefit. Under moderate conditions, typically spring, summer, fall, and temperate winters, 3/8th inch thick synthetic pads commonly have been used as mattresses. One-half inch and thicker pads have been used for extreme conditions. Pads made from thermoformed closed-cell foams are described in U.S. Pat. No. 4,980,936 to Frickland et al. That patent also presents extensive background material on the use of foamed pads. Although closed-cell foam pads could be made thicker, this would increase weight and reduce portability.

The compressibility of open-cell foam sheets, such as polyurethane, has enabled the use of thicker materials, typically ranging from 1.0 to 2.5 inches thick. This increased thickness makes the mattress somewhat more comfortable at the expense of increased weight. For the foam to have sufficient resistance to compression to provide an adequate degree of comfort, foams having a 25% ILD (indention load deflection) of at least about 35 pounds have been used. The comfort benefit of such mattresses is limited due to the characteristics of the human form. When reclining on one's back, pressure points are created at the shoulder, hips, and heels. This focuses most of the weight of the individual on only a small portion of the overall mattress surface. To increase resilience sufficiently to support these pressure points adequately may require increasing, in some combination, the density or thickness of the foam sheet and thus the weight. Furthermore, if higher resilience foams and/or thicker foams are used to give more support, the foam sheet is more difficult to roll up compactly when not in use. These open-cell mattresses also absorb water, which is an obvious problem for products intended for outdoor use. Covering the mattress with a water resistant material increases weight and is not always effective at keeping the foam dry.

Thereafter, inventors created several versions of insulated air mattresses. These designs completely or partially filled an air mattress shell with resilient insulating materials. One such is shown in Swiss Pat. No. 428,124, where the mattress comprises an outer rectangular shaped air-impervious envelope and a foam interior core. The patent notes that the air mattress can be compressed into a stowed position (i.e., rolled up to a relatively small volume) after which the inflating valve of the air mattress is closed to maintain the mattress in its compact stowed configuration. When the valve is opened, the force of the resilient foam core causes the mattress to self-inflate to its expanded position, after which the valve is closed to contain the entrapped air.

A related concept is disclosed in U.S. Pat. No. 4,694,515, which describes a self-inflating air mattress coupled to a foldable bed frame. The airtight mattress envelope encloses resilient means urging the upper and lower faces apart. This approach relies upon the bed frame for the dimensional rigidity necessary to maintain the mattress in a fully extended horizontal position during inflation. When utilizing a lightweight flexible cover material without this separate frame component, the flexible cover edges of the mattress tend to draw together causing the top cover to sag during the self-inflation process and the mattress would only partially inflate when the valve was opened. Further, insulating means, separate from the cover material and resilient means, must be provided.

A somewhat related concept is disclosed in U.S. Pat. No. 2,997,100, which describes a foam filled mattress of a design more commonly used for a conventional household bed. The envelope of this mattress is airtight and can be inflated to a desired pressure, with the air pressure providing a certain degree of additional support for a heavier person.

Another approach to providing a self-inflating foam filled air mattress is disclosed in U.S. Pat. No. 3,798,686. In this patent the resistance of the foam core to compression is utilized in the same manner as the mattress of the abovementioned Swiss patent to give the air mattress its self-inflating characteristic. The foam core shown in this patent comprises upper and lower continuous sheets of open-celled foam, between which are two layers of crossing foam ribs arranged in a lattice.

The foam components are all bonded to one another, and the entire structure is enclosed within a flexible envelope, preferably of a air-impervious nylon type. As such this design does not utilize the compression resistance of the foam to any great degree. Rather, it utilizes the foam to enable self-inflation. This design relies upon the upper and lower continuous sheets of open-cell foam for much of its insulating benefit. This, together with the separate air-impervious cover, leads to the weight penalty associated with the previously mentioned simple open-cell foam sheet mattress.

U.S Pat, No. 4,688,283 to Jacobson, et al. discloses a multi-chambered mattress which utilizes an open-cell foam within a air-impervious nylon cover. Multiple chambers with differing thicknesses of foam are provided. Selected chamber pairs are interconnected to enable the free passage of air between these chambers. The cover is sealed and air valves are provided to enable the independent inflation and deflation of each chamber or interconnected chamber group. The level of support may be varied somewhat by increasing or decreasing the volume of air enclosed within the chambers. This design also relies upon a significant quantity of open-cell foam materials. This foam together with the air-impervious cover leads to the weight penalty.

U.S Pat. Nos. 4,025,974 and 4,624,877 to Lea, et al. disclose a single chamber design which encloses a slab of open-cell foam. The patentees laminate the top and bottom surfaces of an open-cell foam to the inside of a cover made of an air-impervious plastic-coated fabric. Typically a nylon fabric coated with polyurethane ('974) or laminated to solid polymer films is used as the cover. Under the application of heat, the fabric coating softens and bonds with the surface of the open-cell foam slab. This bonding reduces displacement ("ballooning" or "billowing") of the covers and enables better pressure management. Billowing occurs when top and bottom covers are inadequately linked mechanically to each other and are free to expand from one another. Unless it is limited properly, this billowing creates an unstable surface and provides inconsistent support for the user. The foam acts as a compression member in areas of a direct load and as a tension member in areas removed from a direct load. Tensioning of the foam remote from the area of compression causes the pressure to rise in the pad, further resisting the local compression. As such, support is increased at the pressure points. As with the other self-inflating insulated air-mattresses described above, the use of solid open-cell foam sheet and separate air-impervious cover components significantly increases mattress weight. Perforation of the open-cell foam sheet to reduce weight would; a) reduce insulation; b) lead to destructive delamination between the foam sheet and the cover element; c) diminish the mattress's horizontal dimensional rigidity. The insulation value of the open-cell foam sheet is critical since the cover does not provide significant insulating value. In U.S. Pat. No. 4,025,974 at Column 10, lines 14–19 and at Column 11, lines 40–47 it is stressed that it is necessary to bond the cover to the foam-sheet along substantially the entire horizontal surface because there is a tendency when a small area of non-bonding or delamination occurs in an area where the skin is tensioned outwardly for this delamination to spread progressively, even under moderate pressure. As the unbonded area spreads outwardly, the delaminating force at the edge of the delaminating area increases. Given the inflated profile of the cover and open-cell foam sheet when bonded together, perforation of the open-cell foam sheet of U.S. Pat. No. 4,025,974 would accelerate the delamination process. Because of the flexible nature of the air-impervious cover, this design relies upon the open-cell foam sheet for the dimensional rigidity necessary for proper inflation. Extensive perforation of the open-cell foam sheet, to reduce weight, would severely limit the air drawn into the mattress during the self-inflation process. Because of the flexibility of the covers, their edges would tend to draw together and the covers would sag over the void areas during the self-inflation process.

As additional background information, other examples of foam filled structures are disclosed in the following patents: British Pat. No. 984,604; Brawner U.S. Pat. No. 1,159,166; Nappe U.S. Pat. No. 2,834,970; Lerman U.S. Pat. No. 3,323,151; Cornes U.S. Pat. No. 3,378,864; Kain U.S. Pat. No. 3,537,116; and Gottfried U.S. Pat. No. 3,611,455. In U.S. Pat. No. 4,092,750 a metallized film is used in the mattress's interior for added insulation.

Even with the use of tough coated synthetic fabrics, these mattresses are susceptible to punctures. A foreign object only has to penetrate between fabric stands and puncture the very thin polymer coating. Previous designs have focused upon the use of very thin materials, typically in the range of about 4 mils to about 15 mils. When such a mattress is punctured, air pressure is lost, and the mattress's support is reduced.

Finally, the mattress's comfort is limited by the fully sealed nature of the mattress. This limits the mattress's ability to respond to changing conditions, such as switching from lying on one's back to lying on one's side. One example of an attempt to eliminate this limitation is presented in U.S. Pat. No. 4,328,083 to Lineback. This approach locates one or more resilient sub-chambers within the confines of the larger air mattress envelope. When force is applied to the air mattress, the enclosed fluid presses against the resilient sub-chambers. Being open to the atmosphere, these chambers deform, releasing air to the atmosphere, thereby partially releasing pressure within the primary chamber. The fixed resilience of these sub-chambers restrict the ability of the air mattress to respond to individuals with differing weights and to individual preferences.

While the prior art has recognized the value of using an air-impervious inflatable envelope, a variety of mechanical linkages between bottom and top mattress surfaces, frames, separate self-inflation means, insulating, and comfort enhancement components in various combinations, the prior art failed to recognize that by choosing materials having appropriate properties as components of a mattress those properties may be utilized in combination to reduce the amount of or even eliminate components. This allows reduction of weight while optimizing such qualities as portability, puncture resistance, inflatability, insulation and comfort.

SUMMARY OF THE INVENTION

Accordingly, several objects and advantages of my invention arise from a novel mattress construct which provides a mattress combining insulation, air-imperviousness, and structural integrity in one component. This combination of features reduces or eliminates the need for separate cover and insulating components except under extreme conditions. The invention comprises an insulated mattress which is a substantially fluid-impervious inflatable enclosure having a closable means such as a valve or stopper for admitting to and releasing from the enclosure a fluid such as air, water, or the like and also permits varying the quantity of enclosed fluid. When the closable means is opened, air or other liquid is introduced to inflate the mattress. Closure maintains the mattress in the inflated mode. The enclosure of the invention:

has enhanced puncture resistance;
has insulating characteristics;
has lower overall weight; and
affords greater design flexibility due to decreased weight for the components of the basic mattress features In a preferred embodiment the mattress contains sufficient compressible resilient units attached to the inner surfaces of the enclosure to cause the enclosure to self-inflate when a fluid is admitted to the enclosure and substantially reduce billowing of the enclosure under a load.

In another embodiment the invention provides a mattress which provides increased internal bond reliability by pre-contouring the bonding surfaces of the foam inflation/displacement control modules and/or the insides of the covers.

In another embodiment the invention provides a mattress in which the covers have been thermoformed and bonded together in a manner which affords the mattress an inherent tendency to displace the covers from each other, thus causing a fluid to be admitted into the mattress when it is opened.

In another embodiment the invention provides a mattress with a raised pillow area to increase user comfort. Another embodiment of the invention provides a mattress configured with a removable fabric pillow assembly which may be stuffed with available resilient materials such as extra clothing to increase user comfort. Another embodiment of the invention provides a mattress with increased user comfort and mattress reliability by providing a user configured pressure control chamber. Another embodiment of the invention provides a mattress which increases user comfort by providing a user configured lumbar support assembly. Another embodiment of the invention provides a mattress for use during extreme weather conditions without extra external insulating materials by using at least one layer of film or sheet in the interior of the enclosure as a baffle to minimize the transfer of heat to the ground by internal convection currents and/or radiation. Still further objects and advantages will become apparent from a consideration of the ensuing description and drawings.

DESCRIPTION OF THE FIGURES

FIG. 6 also shows an optional pillow assembly which covers one end of a mattress.

DETAILED DESCRIPTION OF THE INVENTION

Figure 1A:
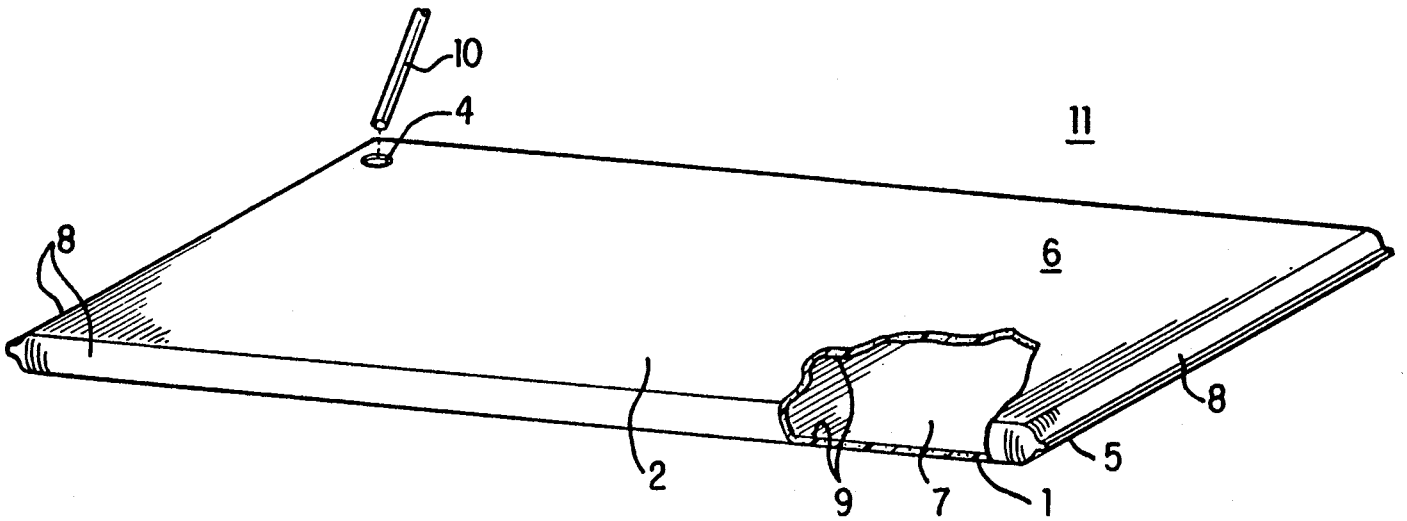
FIG. 1*a* shows a cutaway view of the internal structure of a mattress of the invention.

An embodiment of the present invention is illustrated in FIG. 1*a*. The mattress consists of bottom and top cover elements or surfaces 1 and 2 having edge connections 5 to form a substantially fluid-impervious flexible enclosure. The cover may be formed of any relatively thick, puncture resistant, fluid-tight, resilient semi-rigid closed-cell foamed material. The term "resilient semi-rigid closed-cell foam" as used herein means a semi-rigid closed-cell foam which has sufficient rigidity to be substantially self-supporting between two support points and will withstand a 180° mandrel bend and substantially return to its original form. Appropriate cover materials include, but are not limited to, resilient semi-rigid closed-cell foams of polyethylene, ethylene-vinyl acetate (EVA), blends of ethylene polymers and/or copolymers, PVC, polyurethane, natural or synthetic rubber and the like. Typically the thickness of the cover may range from about 3/16" or less to about ⅜" or more. Typically the densities of commercially available materials vary from about 1.5 to about 6 lb/ft$^3$. Some are offered with high-friction or textured surfaces. Thinner materials which are denser, or have skin-like surfaces are also available. A commercial product Epilon® (Youngbo America), a cross-linked ethylene polymer foam having a density of about 2 lb/ft$^3$ has been found to be suitable for the purposes of the invention. The thickness of covers of the invention should be contrasted to typical covers of the prior art which range from about 4 to 15 mils thick. The increased thickness and the inherent toughness of the covers of the mattress of the present invention significantly improve the mattress's resistance to punctures, while the semi-rigid nature of the cover imparts the horizontal dimensional rigidity required for dimensional stability of the mattress. The resilient cover materials of the invention are typically more extensible or stretchable than the coated fabrics or plastics utilized by the prior art. This resilience enables the volume of the mattress to increase in response to sudden pressure surges without failure of the integrity of the enclosure. Resilient semi-rigid closed-cell foams having a density of about 2 pounds per cubic foot are preferred for use as the covers. For a sleeping mattress, typical inflated dimensions are about 20 to 40 inches wide, 45 to 80 inches long, and 1 to 9 inches thick. While rectangular mattress constructions are most common, other shapes may be used. For example, a mattress may have an egg-like shape in the horizontal dimension which would provide a wider support area for the user's upper body and a narrower support area for legs and feet.

Figure 3A:
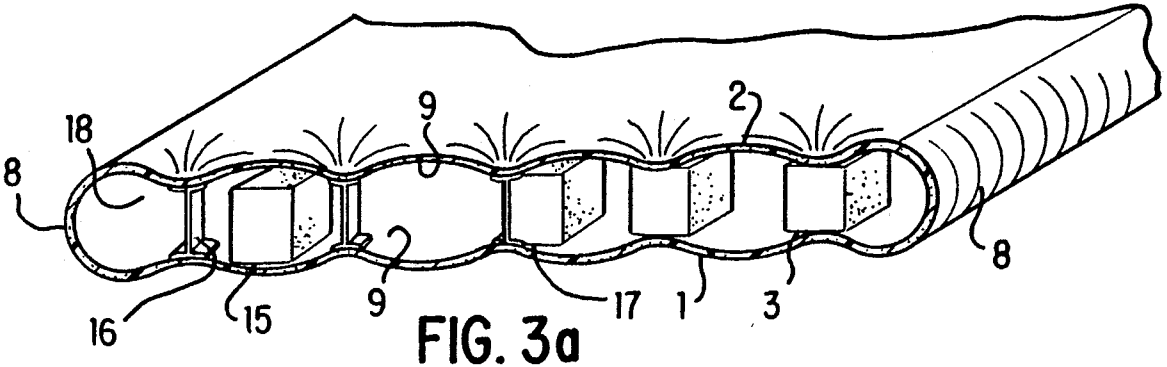
FIG. 3*a* shows the profile of a mattress of the invention when inflated and shows a number of alternative inflation and/or displacement control mechanism configurations.
Figure 2:
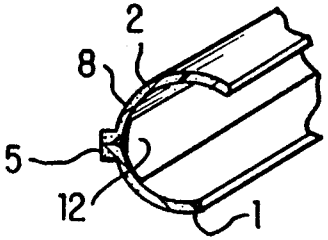
FIG. 2 shows an optional edge reinforcement strip for the seams of the mattress of the invention.

A tube formed from a sheet of closed-cell foam material may be used to provide both cover surfaces 1 and 2 as shown in FIG. 3*a*. Making such tubes from low density polyethylene is disclosed in U.S. Pat. No. 4,761,328 to Shin. Another method for forming a tube is to join two edges of a sheet of material with a butt bond. When a tube is used as the cover, the top and bottom surfaces 1 and 2 only require edge bonds to form the connections 5 along two opposite sides. Folds form the connections on the remaining two sides. This construction joins the two edges to create a tube. Where discrete bottom and top cover elements 1 and 2 are utilized, edge bonds or seams are required along all four sides 8 to form the edge connections 5 of the mattress as shown in FIG. 2. The edge seal may be effected using thermal bonding or adhesive techniques well-known in the art. Thermal bonding involves heating the adjacent surfaces until they soften, pressing the two surfaces together, and holding until the bonded region cools sufficiently. Adhesive bonding may use any suitable adhesive such as contact adhesives, solvent-based adhesives, hot-melt adhesives or the like. An optional fabric reinforcement strip 2 may be provided to reduce the stress on the edge bonds 5 as shown in FIG. 2. In the absence of a reinforcing strip stress may be localized at the very edge of the bond. This strip spreads the stress across the general area adjacent to each side of the bond.

A valve assembly or equivalent closure 4 is used to enable the controlled exchange of fluid (air, water, etc) between the enclosed volume of the mattress and the atmosphere. This valve assembly may be placed in any convenient location, for example within an edge bond seam forming the connection 5 (between bottom and top 1 and 2 cover elements) or in one of the two covers. Location at or near one of the ends of the enclosure facilitates fluid-expulsion, rolling (or folding), and stowing of the mattress.

Figure 1B:
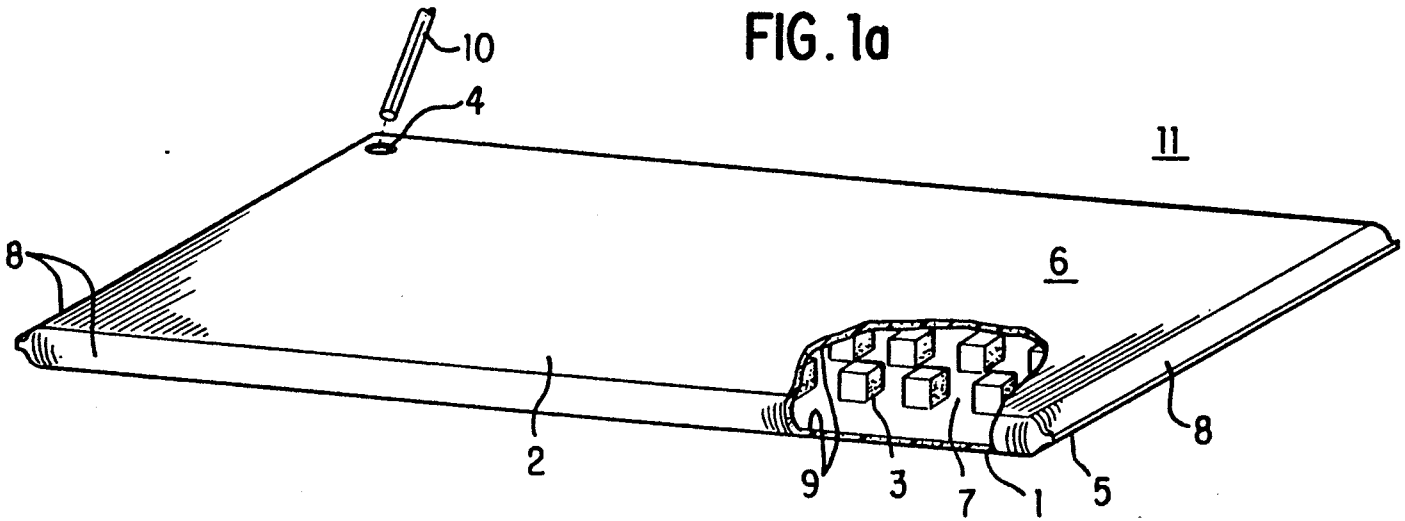
FIG. 1*b* shows a cutaway view of the internal structure of a mattress which contains a number of inflation/-displacement control modules.

In a preferred embodiment of the invention shown in FIG. 1*b* a mechanism 3 is provided to force the covers 1 and 2 apart and cause self-inflation of the mattress. Because of the semi-rigid (horizontal dimensional rigidity) nature of the covers 1 and 2, it is only necessary to apply force at a few discrete points throughout the interior surfaces 9 of the mattress to separate the covers 1 and 2 and cause self-inflation. In prior art constructions either a separate frame or a substantially continuous internal surface pressing against the inside of the cover has been required. For this invention this force may be provided by resilient modules 3. A light weight material having a density in the range of about 0.8 to 1.8 pounds per cubic foot such as an open-cell foam (polyurethane or polyether foam, neoprene polymer foam, low density polyethylene foam, ethylene copolymer foam, polyisoprene sponges, or the like), springs, or bonded fibers is preferred. The modules 3 are held in place by bonding to the inside 9 of one or both of the covers i or 2 or to some other fixed element within the mattress.

Cover displacement is limited by mechanically linking the bottom and top covers 1 and 2. A number of configurations may be used to link the bottom and top covers 1 and 2. Several alternatives are shown in FIG. 3*a*. The preferred configuration combines cover displacement and self-inflation functions in a single inflation/displacement control module 3 made from any of the light-weight resilient materials described above. When used as a combined inflation displacement control module, the material for the module is selected to provide sufficient tensile strength to restrain the covers for displacement control and sufficient resilience to have the compression and expansion properties necessary for the inflation functions. The elasticity of the cover materials and the inflation/displacement modules enables the mattress volume to effectively increase in response to sudden pressure surges thereby reducing bond failures between the control modules 3 and the inside surfaces 9 of the covers. In another embodiment a flexible component 16 made of fabric or plastic sheeting may be used to limit/control separation of the covers 1 and 2. The displacement limiting components 16 are distributed throughout the interior of the mattress and thermally or adhesively bonded to the inside 9 of the bottom and top covers 1 and 2. The fabric component 6 may take the form of an "I-beam", a circular tufted structure or a similar construction. In this approach, a separate resilient inflation component 5 is provided to force the two covers 1 and 2 apart. Alternately the self-inflation and displacement control mechanisms may be bonded to one another as illustrated by 17 in FIG. 3*a*. The displacement control mechanism is then bonded to the covers 1 and 2.

The inflation function may also be provided by using perforated or convoluted resilient sheets which extend substantially to the interior margins of the mattress. These constructions preferably rely upon bonding the resilient sheet to the interior sides 9 of the top 2 and bottom 1 sheets for displacement control. Alternatively a perforated sheet or block of open-celled polyurethane, rubber foam or the like may be used in combination with separate displacement control modules 16, in which case it is not necessary to bond the sheet to the interior surfaces 9 of the covers. The perforations may have any form such as circular, square, or rectangular or the like, and may pass partly or completely through the sheet, leaving adequate material for the inflation and, where intended, displacement control functions.

The spacing of the modules is influenced by a number of factors. Placement of the displacement control modules is principally determined by: the degree of billowing (or ballooning) of the cover which is acceptable; the strength of the cover material selected; and the external forces which are expected to be applied to the mattress which determine the internal pressure which must be handled and therefore the strength of the modules 3 and their associated bonds. For a typical air mattress for use in camping and the like which may have a width of 20 to 25 inches, four to six rows of modules have been found to provide the preferred balance between weight, ease of manufacture and comfort. This leads to an intermodule (on center) spacing of from about 2.85 to about 5 inches. The inflation modules must be sized to provide adequate inflation force and sufficient tensile strength to resist the increased internal pressure when an external load is placed on the mattress. Thus although the size and number of these modules is dependent upon the material selected and the intended application, the size and number for a particular application may be determined readily by routine experimentation. For the camping mattress application described above, when using open-cell polyurethane foam, the preferred module bonding surface size will be approximately 1 to 4 square inches (each end). Since the cover provides the necessary dimensional rigidity, a perforated open-cell foam sheet having a very high void space level may also be used.

Figure 3B:
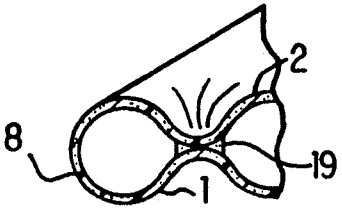
FIG. 3*b* shows the profile of a mattress of the invention having covers which have been shaped in a manner to encourage the covers to separate when fluid is admitted to the enclosure.

FIG. 3*b* presents a partial view of a mattress which utilizes the resilience and semi-rigid nature of the cover material by predistorting at least one of the bottom and top surfaces 1 and 2 of the enclosure to approximately its inflated profile by means such as thermoforming, molding or the like. When a fluid such as air is admitted to the enclosure the resilience and semi-rigid character of the cover forces the bottom and top covers 1 and 2 apart. A similar effect may be achieved by predistorting or pretensioning the cover material in the area where the bottom and top covers 1 and 2 are bonded to each other. The deformation or dimpling forces the covers X and apart when fluid such as air is admitted to the enclosure. In the example depicted in FIG. 3*b* one or both of the cover materials are thickened 19 in the bonding area(s) to form ridges, ribs or the like and are bonded together at that place. When the mattress is unrolled the distortion of the covers caused by the thickening at the point(s) of attachment forces the covers apart. The thickened area 19 may also be formed by attaching a relatively inextensible material to the covers 1 and 2. An alternative would be to place the thickening or distortion on the outside of the covers.

Beginning with a rolled (stored) mattress, the method of operation is as follows. The user places the rolled mattress on the ground, opens valve 4, and unrolls the mattress. This allows the free entry of air or other liquid into the enclosed mattress chamber 7. If air is to be used, it may be blown or pumped into the enclosure through the closure means 4. If the mattress is to be filled with a liquid such as water as for a water bed, water may be forced into the enclosure through the valve 4 or an extension tube 10 may be run from the mattress to a water tap. This pressure of the fluid forces apart the bottom and top covers 1 and 2. The degree of fill of the enclosure may be adjusted somewhat to suit the user's preference. When the mattress is fully expanded, the valve 4 is closed to retain the mattress in the inflated mode.

When the user is ready to stow the mattress, the valve 4 is opened. The mattress then is rolled in the direction of the valve 4, forcing air or liquid out of the mattress. When the mattress has been completely rolled up the valve 4 is closed which helps to maintain the mattress in the rolled state.

When using the preferred self-inflating form of the invention the method of operation is as follows. The user places the rolled mattress on the ground, opens valve 4, and unrolls the mattress. This allows the free entry of air into the enclosed mattress chamber 7 thereby allowing expansion of the resilient inflation/displacement control modules from their compressed (collapsed) condition. This expansion of the modules forces apart the bottom and top covers 1 and 2. If it is desired to fill the mattress with a liquid such as water as for a water bed, the valve 4 may be immersed in a reservoir of the liquid, or an extension tube 10 may be run from the mattress to the reservoir or a water tap. When the modules are fully expanded, the valve 4 is closed to retain the mattress in the inflated mode. If desired, the user may force a little air or other fluid out of the mattress, or blow several breaths of additional air or pump additional air or fluid into the mattress, in order to vary the mattress volume to suit the user's individual preferences. When the user is ready to stow the mattress the procedure is the same as above.

Figure 4C:
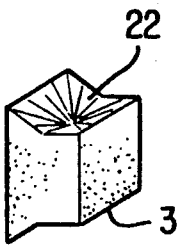
FIGS. 4*a*, 4*b*, 4*c*, 4*d*, and 4*e* show a number of alternative optional shaped or contoured bonding surfaces which may be utilized on small spot, narrow elongated strip foam, perforated sheet, and formed/machined sheet inflation/displacement control module configurations. A configuration suitable for transition locations where the displacement between upper and lower mattress surfaces changes is shown in FIG. 4*c*.
Figure 4B:
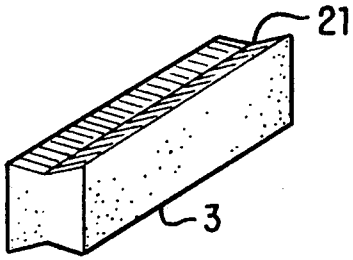
Figure 4A:
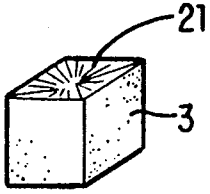
Figure 4E:
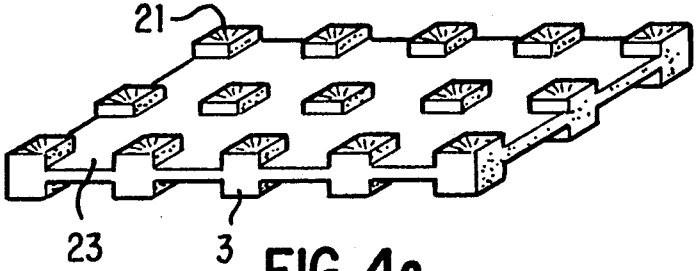
Figure 4D:
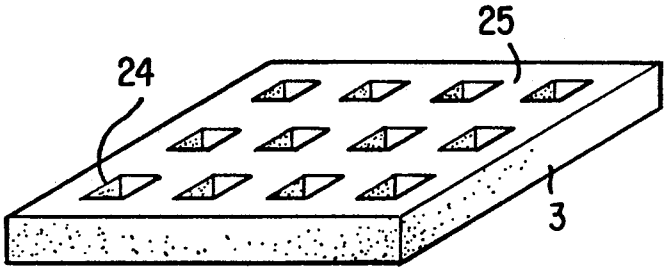

Use of a preferred combined inflation/displacement control module 3 minimizes the number of components required to enable self-inflation and displacement control functions. The resilient modules 3 serve to first force apart and then maintain or stabilize the displacement between the two covers. Self-inflation occurs when the valve 4 is opened, which allows entry of air or other liquid and effecting self-inflation. Closing valve 4 will maintain the mattress in the inflated mode. FIGS. 4*a–e* presents several expanded views of alternative individual resilient inflation/displacement control modules 3. While square and rectangular (in the horizontal dimension) modules 3 and cutouts 24 are represented, many shapes are appropriate including circular and oval and the choices are limited only by the ingenuity of the designer. Contoured bonding surfaces 21 of the modules 3 optionally may be used to equalize the stress across the entire bonding cross-section of the module. When this approach is used, the surface slope 21 is selected to match the wave profile of the inflated cover as shown in FIG. 3*a*. This stress equalization eliminates localized areas of excessive stress which might lead to bond edge peel and subsequent bond failure between the module 3 and the inside cover surface 9. Alternatively some or all of the contouring may be done to the bonding areas of the inside cover surface 9 rather than just to the module(s) 3. The contouring may be accomplished by means such as thermoforming, molding, surface machining and the like. The shape of the contour is selected to balance the profile of the inflated cover and thereby provide a substantially planar bonding surface when the mattress is inflated. FIG. 4*c* shows a contour 22 which may be used for locations where the displacement or separation between the upper and lower mattress surfaces is varied as in a contoured mattress. This contour equalizes stress across the displacement change region. FIG. 4*d* presents a construction utilizing a perforated resilient sheet 25 in place of the several inflation/displacement modules 3. The material of the perforated sheet 25 which remains between the perforations 24 may be contoured to equalize stress across the bonding surface when the foam is to be adhered to the inside 9 of the bottom 1 and top 2 covers. FIG. 4*e* shows another construction which utilizes a sheet of open-cell foam or other suitable material 23. Modules 3 may be formed or machined as part of sheet 23 or bonded to the sheet 23. Sheet 23 reduces convection currents within the mattress enclosure. The single unit form shown in FIGS. 4*d* and 4*e* may be utilized to advantage during manufacturing to facilitate assembly. When resilient materials are utilized as combined inflation/displacement control modules, they may serve an additional pressure relief function. In addition to compression, resilient materials such as open-cell polyurethane foam may be elongated (stretched) under tension forces to greater than its normal length. Typical maximum elongation values for open-celled polyurethane foams range from 150% to 250%. Thus when sudden external loads are placed on the mattress increasing the internal pressure, the foam elongates, increasing the internal volume, thereby reducing the internal pressure.

Figure 5:
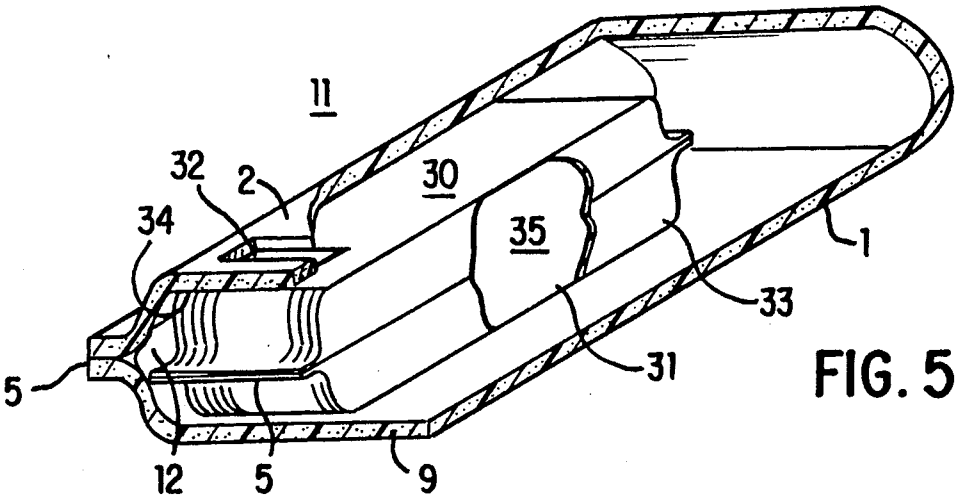
FIG. 5 shows an optional pressure/comfort control assembly.

The optional pressure control chamber 30 presented in FIG. 5 is a sub-chamber located within the main mattress chamber 7. The chamber's shell 33 may be constructed of any flexible air-impervious material such as coated nylon, rubberized fabrics, polyethylene film or the like. The surface of this chamber having an opening 32 is bonded to the inside 9 of one of the covers. One or more of the opening(s) 32 between the interior of the chamber 35 and the outside atmosphere 11 is provided within this bonded area. The opening 32 is configured to enable the ready exchange of air between the interior 35 of the chamber 30 and the atmosphere 11. The chamber 30 is filled with a resilient material 31. The chamber 30 is structured to enable the user to select the quantity and resilience of the material 31 and then insert it into the chamber 30. Resilience characteristics may be consistent throughout the chamber's or varied to increase resistance to compression as the pressure increases. After filling the chamber 30, the opening(s) 32 is partially closed to retain the resilient material 31 but allow continued air exchange between the chamber 30 and the atmosphere 11.

If the chamber 30 is not already filled, the user may select the resilience of the fill material 31 and fill the pressure control chamber 30 with resilient materials 31 through opening(s) 32. This chamber serves dual purposes. First, it minimizes the effect of sudden localized loads placed on the mattress, such as someone stepping on the mattress reducing the possibility of failure of the bond linking the inflation/displacement control module 3 to the covers 1 and 2. Similar to elongation of the modules 3 and stretching of the covers 1 and 2, compression of the chamber allows relief of the overpressure condition. The user stepping on the mattress 6 would increase the pressure within the main mattress enclosure 7, press against the chamber 30, overcome the resistance of the resilient materials 31, and force air out of the chamber 30 through the opening 32. This in turn would reduce the pressure within the main mattress enclosure 7, allowing the top surface 2 to deflect, and relieving the overpressure condition. An added benefit of the chamber 30 is to assist in maximizing user comfort. When the user reclines on the mattress, pressure points are created at several locations along the body's contact area with the mattress. Further, the number and size of these pressure points varies with the position of the user (lying on the back, side, or stomach). The pressure points are somewhat relieved by the compression of the fluid within the mattress and the localized deflection of the mattress cover. This response can be optimized by varying the quantity of fluid within the mattress for selected weight disposition profiles. This response can be optimized for one body position but not for all positions. The chamber 30 assists this effect by allowing additional controlled pressure relief when the user changes positions.

Figure 6:
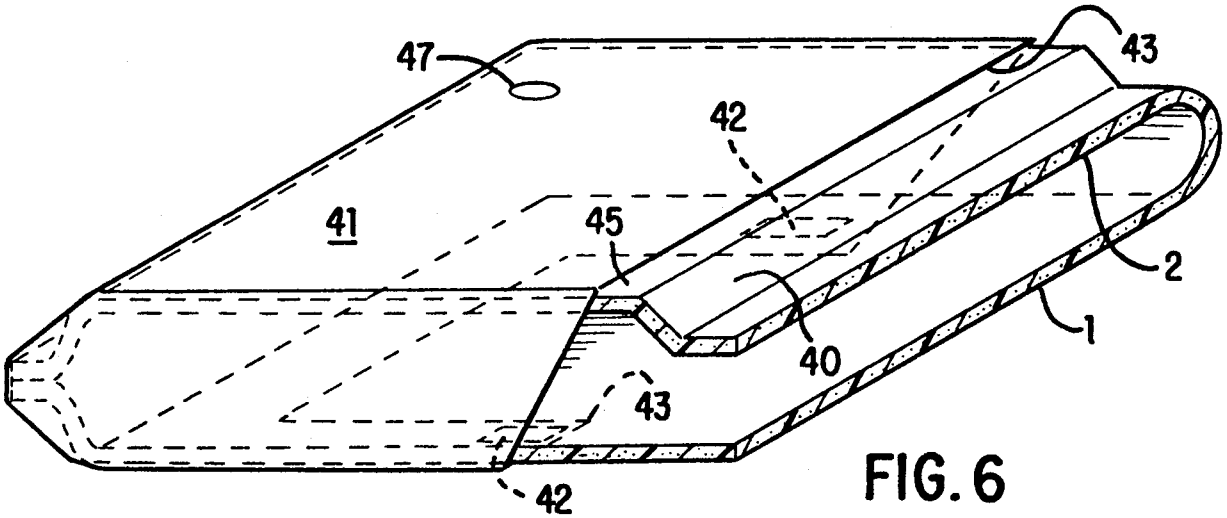
FIG. 6 shows an optional elevated pillow region on the mattress of the invention.

An optional raised pillow region 45 is shown in FIG. 6. This region may be elevated approximately 0.5" to 1.5" relative to the remaining top cover surface 2. This elevation increases user comfort with little increase in mattress weight. Elevation may be achieved by the use of longer inflation/displacement control modules 3 in that region. As indicated in FIG. 4*c*, the bonding surface 22 of the modules 3 adjacent to the elevated area 45 may be contoured to balance increased stress at the transition boundary 40.

FIG. 6 also presents an optional pillow assembly 41 which covers the top of a pillow region 45. Assembly 41 extends around the top and side edges of the mattress and several inches under the bottom of the mattress. The assembly is attached to the mattress at several attachment points 42 on the bottom 1 of the mattress. Suitable means of attachment of pillow 41 to the mattress 6 include but are not limited to Velcro, ties, and snaps. This approach enables the user to remove the assembly 41 completely or to slightly reposition the assembly 4 to allow space for more or less filler materials. Holes 47 in the pillow assembly may be provided, as necessary, to allow access to the valve assembly 4. The user may stuff any available resilient materials, such as clothing, into the space 48 between the mattress's top cover 2 and the inside of the pillow assembly 4. This serves to raise the level of the area on which the head resides and provide a resilient surface, increasing user comfort.

Figure 7:
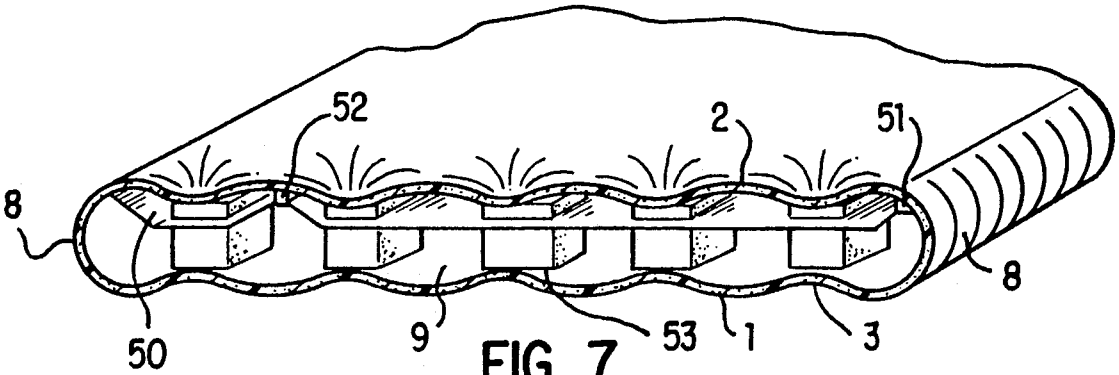
FIG. 7 shows a mattress having an optional lightweight sheet or baffle enclosed within the mattress to further increase its insulating properties.

If additional insulation value is desired, at least one thin lightweight sheet 50 may be configured within the main mattress chamber 7 enclosed by covers 1 and 2 in a manner such that it substantially extends to the edges 8 of the enclosure, or extends to an inside cover surface 9 in the area between the edge 8 and the module(s) 3 closest to the edge, thus acting as a baffle to reduce convection currents between the upper surface of the mattress and the ground. In order to maintain its position within the enclosure the edges of the sheet 50 may be attached to the inside surface at or near one or more of the edges 8. When the sheet 50 is attached to the inside cover surface 9 space must be left to allow admission of fluid into the space between the sheet 50 and the cover surface 9. Alternatively, one or more small holes may be made in the sheet 50 to admit the fluid. Such small holes will not contribute significantly to losses of heat by convection currents. The sheet 50 should be positioned so that when the enclosure is inflated, except for any point(s) where it is attached to the edge(s) 8 of the enclosure, its surface is at least 0.1 inch from one of the inner surfaces of the enclosure or any additional sheet(s) 50. As shown in FIG. 7, resilient modules 3 may be used to advantage for positioning and/or supporting the sheet 50. Appropriate materials for use as the sheet 50 include but are not limited to heat reflective metallized plastic films such as aluminized Mylar and simple flexible plastic films of polyethylene or the like or a sheet 23 provided as part of the inflation/displacement control construction as shown in FIG. 4*e*. The presence of sheet 50 reduces air convection currents within the main chamber 7. Use of an aluminized sheet will also reduce radiant heat loss from the inside 9 of the top cover 2. The spacing of the sheet 50 from the adjacent surfaces 2 or any additional sheets, is critical to its effective insulating value. Contact between surfaces will lead to heat loss through conduction. Excessive space between the sheets will lead to increased convection currents. An inter-sheet spacing in the range of approximately 0.1 to 1.0 inches is desirable. This spacing control may be provided by the resilient modules 3. Additional control may be provided by modules 51 and 52.

Figure 8:
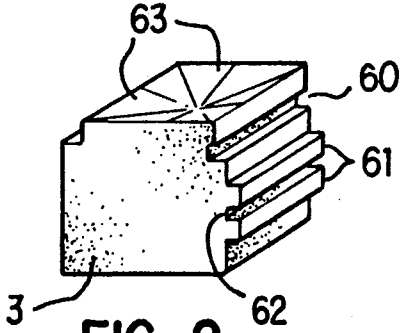
FIG. 8 shows several alternative foam module configurations which may be used to facilitate proper positioning of the optional baffle.

Sheet 50 may be bonded or physically attached (positioned) to the modules 3. Where bonding is applied, a sheet support surface 63 may be configured on resilient modules 3, 51, and 52. FIG. 8 shows a module having several alternative configurations suitable for physically attaching the sheet to the module. A slot 60 provides a recessed profile into which the sheet 50 would protrude. An alternative type of slot 62 is configured by a pair of everted sheet guides 61. The configuration of bonding or physical attachment surfaces such as surfaces 60, 62 or 63 will determine the spacing between the cover 2 and sheet(s) 50. When the modules are first attached to a sheet 50, the sheet may then be used to facilitate proper positioning of the modules for attachment to the bottom and top covers. If multiple sheets are to be used, additional surfaces similar to surface 60, 62, or 63 may be employed to secure proper positioning of the additional sheet(s).

Figure 9:
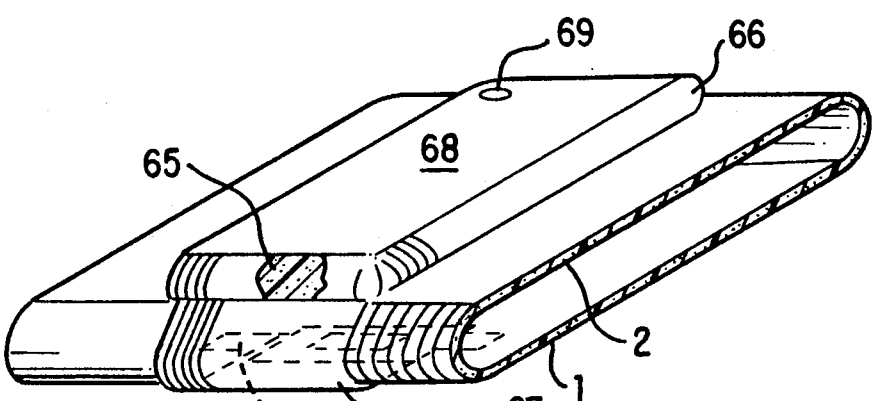
FIG. 9 shows an optional movable, adjustable resilient lumbar support pad with the mattress of the invention.

FIG. 9 shows an optional external lumbar support pad assembly 68. The cover 66 may be formed in the same way as a mattress 6 from a tube with sealed ends or from two sheets joined around their edges to form an air-tight envelope. Part of this cover 67 extends under the primary mattress chamber. Attachment means 42, such as Velcro, ties, or snaps is provided to attach this assembly to the bottom i of the mattress. This attachment enables the user to relocate the lumbar support pad assembly to suit his/her individual preferences. Resilient materials 65 are contained within this lumbar support pad envelope. These materials may be inserted during the manufacturing process. The overall thickness of the pad may be approximately 1.0 to 1.5 inches. A valve 69 may be provided to enable the user to alter the amount of air contained within the lumbar pad envelope This enables the user to vary the thickness and the amount of support provided. As with the pressure control chamber 30, this lumbar support pad assembly 68 may be configured to provide for user selection (and fill) of resilient materials 65. To use the lumbar assembly, the user first determines the optimal placement of the assembly to suit personal preference. The assembly is then attached at the appropriate locations using attachment points 42. Valve assembly 4 is opened to enable inflation of the assembly. If desired, the user may close valve 4 to maintain the inflation when the user reclines upon the lumbar assembly. As with the main mattress, the user may press some of the air out or add additional air prior to closure of the valve.

I claim:

1. An inflatable enclosure formed of substantially air-impermeable resilient closed-cell foam wherein the thickness and density of the closed-cell foam has been selected to provide semi-rigid characteristics between adjacent points of support comprising top and bottom surfaces connected at their edges to form the enclosure and having at least one closable means for admitting a fluid to and releasing fluid from the enclosure.

2. The enclosure of claim 1 wherein at least one of said top and bottom surfaces has been predistorted to approximately its inflated profile to cause said enclosure self-inflate when air is admitted to the enclosure.

3. An inflatable enclosure formed of substantially air-impermeable closed-cell foam has been selected to provide semi-rigid characteristics between adjacent points of support comprising top and bottom surfaces connected at their edges to form the enclosure which contains a plurality of compressible resilient units attached to opposite points of the inside of said top surface and the inside of said bottom surface of said enclosure (a) to cause self-inflation of the enclosure when air or another fluid is admitted to the collapsed enclosure; and (b) to substantially reduce billowing when a weight is placed on the inflated enclosure;

said enclosure having at least one closable means for admitting a fluid to and releasing fluid from the enclosure.

4. The enclosure of claim 3 wherein at least one thin sheet of a flexible material is positioned within the enclosure in such a manner that any unattached surfaces of said sheet will be from about 0.1 inch to about 1 inch removed from the inner surface of the enclosure and from any additional such sheets when the enclosure is inflated.

5. The enclosure of claim 4 wherein the sheet of material is supported by the compressible resilient units which are bonded to the inner surfaces of the enclosure.

6. The enclosure of claim 3 wherein at least one of (a) the surfaces of the compressible resilient units which are bonded to the inner surfaces of the enclosure, and (b) the areas of the inner surface to be bonded to the compressible resilient units, has been contoured to the approximate profile of the surfaces of the enclosure in the region of the bonds between said units and said surfaces when the enclosure is inflated.

7. The enclosure of claim 3 which comprises at least one expansion chamber formed by a second enclosure made of a substantially air-impermeable flexible material within said enclosure; said second enclosure being capable of being filled with a resilient material and having means to exchange air with the ambient atmosphere.

8. The enclosure of claim 3 wherein the compressible resilient units in a region of the enclosure are longer than other such units to form an elevated pillow area on the enclosure.

9. An inflatable enclosure formed of substantially air-impermeable material comprising top and bottom surfaces connected at their edges to form the enclosure which contains sufficient compressible resilient units attached to opposite points of the inside of said top surface and the inside of said bottom surface of said enclosure (a) to cause self-inflation of the enclosure when air or another fluid is admitted to the collapsed enclosure; and (b) to substantially reduce billowing when a weight is placed on the inflated enclosure;

wherein at least one of (a) the surfaces of the compressible resilient units which are bonded to the inner surfaces of the enclosure, and (b) the areas of the inner surface to be bonded to the compressible resilient units, has been contoured to the approximate profile of the surfaces of the enclosure in the region of the bonds between said units and said surfaces when the enclosure is inflated; said enclosure having at least one closable means for admitting a fluid to and releasing fluid from the enclosure.

* * * * *